US006748627B2

(12) United States Patent
Kotsatos et al.

(10) Patent No.: US 6,748,627 B2
(45) Date of Patent: Jun. 15, 2004

(54) COMBINATION HANDLE AND CABINET FASTENER

(75) Inventors: Andrew Kotsatos, Arlington, MA (US); Doug Hogue, Peabody, MA (US); David G. Kroll, North Attleboro, MA (US); Stephen Mills, Atkinson, NH (US); Carol Catalano, South Hamilton, MA (US)

(73) Assignee: Boston Acoustics, Inc., Peabody, MA (US)

( * ) Notice: Subject to any disclaimer, the term of this patent is extended or adjusted under 35 U.S.C. 154(b) by 0 days.

(21) Appl. No.: 10/256,273

(22) Filed: Sep. 26, 2002

(65) Prior Publication Data

US 2004/0060153 A1 Apr. 1, 2004

(51) Int. Cl.[7] ..... A45C 13/26; A45F 5/10

(52) U.S. Cl. ..... 16/443; 16/416; 312/244

(58) Field of Search ..... 16/443, 415, 416; 181/144–150, 153, 198, 199; 381/337, 348, 349; 312/244, 348.6, 228; D14/172, 214, 221, 204, 210

(56) References Cited

U.S. PATENT DOCUMENTS 3,860,755 A * 1/1975 Kimbell et al. ..... 381/109
4,093,327 A * 6/1978 Linger ..... 312/244
4,484,788 A * 11/1984 L'Homme et al. ..... 312/348.6
4,815,559 A * 3/1989 Shirley ..... 181/144
5,134,754 A * 8/1992 Vickers ..... 16/416
D375,499 S * 11/1996 Meyer et al. ..... D14/214
D402,528 S * 12/1998 Brucker ..... D8/313
5,927,836 A * 7/1999 Herr et al. ..... 312/244
5,996,728 A * 12/1999 Stark ..... 181/144
D419,158 S * 1/2000 Mackie et al. ..... D14/214
D433,012 S * 10/2000 Arsenault ..... D14/221
D439,238 S * 3/2001 Mackie et al. ..... D14/214
D444,457 S * 7/2001 Kuo ..... D14/214
6,561,311 B2 * 5/2003 Chuang ..... 181/199

OTHER PUBLICATIONS

U.S. patent application Ser. No. 29/168115, Kotsatos, et al., filed Sep. 26, 2002.

* cited by examiner

*Primary Examiner*—Chuck Y. Mah
(74) *Attorney, Agent, or Firm*—Wolf, Greenfield & Sacks, PC

(57) ABSTRACT

A loudspeaker assembly comprising a cabinet and a grille in which the grille is at least secured in part to the cabinet sides by a pair of handgrips that are shaped and sized to permit lifting of the unit using fingers of a hand.

20 Claims, 3 Drawing Sheets

COMBINATION HANDLE AND CABINET FASTENER

SUBJECT MATTER OF INVENTION

The present invention relates to a handle or grip and, in particular, to a multi-functional grip or handle for a cabinet.

BACKGROUND OF INVENTION

Audio equipment, such as loudspeakers, require cabinets which are large and frequently heavy, particularly when the cabinet is designed for woofers and other heavy electronic equipment such as amplifiers. Since these speakers frequently are used in homes or other facilities in which their appearance is a necessary commercial consideration, the cabinet design requires careful consideration. In addition to aesthetic consideration, these cabinet designs must satisfy several functional needs. The cabinets may occasionally have to be moved from one location to another. Since the cabinet is generally large and rectangular in shape, lifting or moving the cabinets may be facilitated by providing handles for the cabinet. However, handles which project from the cabinet have several deficiencies. Among these are that loudspeaker cabinets are frequently located in small and confined spaces, such as in cabinetry or on shelves and projecting handles may not be desirable in such closed spaces. In addition, many individuals have reason to remove the face covers or grills from the cabinets for modification repair or the like. Handles should not interfere with such removals. These requirements and needs, thus present a need for an improved cabinet system for loudspeakers and other audio equipment.

SUBJECT MATTER OF INVENTION

It is an object of the present invention to provide an improved means for lifting or moving cabinets containing audio equipment such as loudspeakers. A further object of the present invention is to provide an improved handgrip for moving or lifting speaker cabinets in which the handgrip serves a dual function of securing the face cover or grille to the cabinet.

A still further object of the present invention is to provide an improved handgrip for loudspeaker cabinets in which the handgrip is designed to closely to the contours of the cabinet while still providing a sufficient surface or engaging area to permit one to lift relatively heavy cabinets. One further object of the present invention is to provide a handgrip that is functionally and aesthetically improved for loudspeaker cabinets. A still further object of the present invention is to provide a handgrip for securing a face cover or grille of a cabinet to cabinet side walls in a manner which facilitates the removal of the face cover or grille when access to the cabinet interior is required.

In the present invention, there is provided an audio unit having a cabinet with opposing sides and a separable face cover or grille therebetween. Means are provided for securing the edges of the face cover to the opposing sides of the cabinet comprising one and preferably a pair of handgrips positioned on either side of the cabinet with a portion of the handgrip engaging the side and a portion of the handgrip engaging the face cover. The invention further contemplates providing means for securing handgrips to a cabinet face cover, in the form of a cup having a peripheral flange that extends about the edge of the cup with the peripheral flange in facing engagement with both the surface of the cabinet side and the edge of the face cover or grille.

These objects, as well as others, of the present invention will be more readily understood from a consideration of a detailed embodiment of the present invention as illustrated in the accompanying drawings, in which:

DETAILED DESCRIPTION OF PREFERRED EMBODIMENTS

Figure 1:
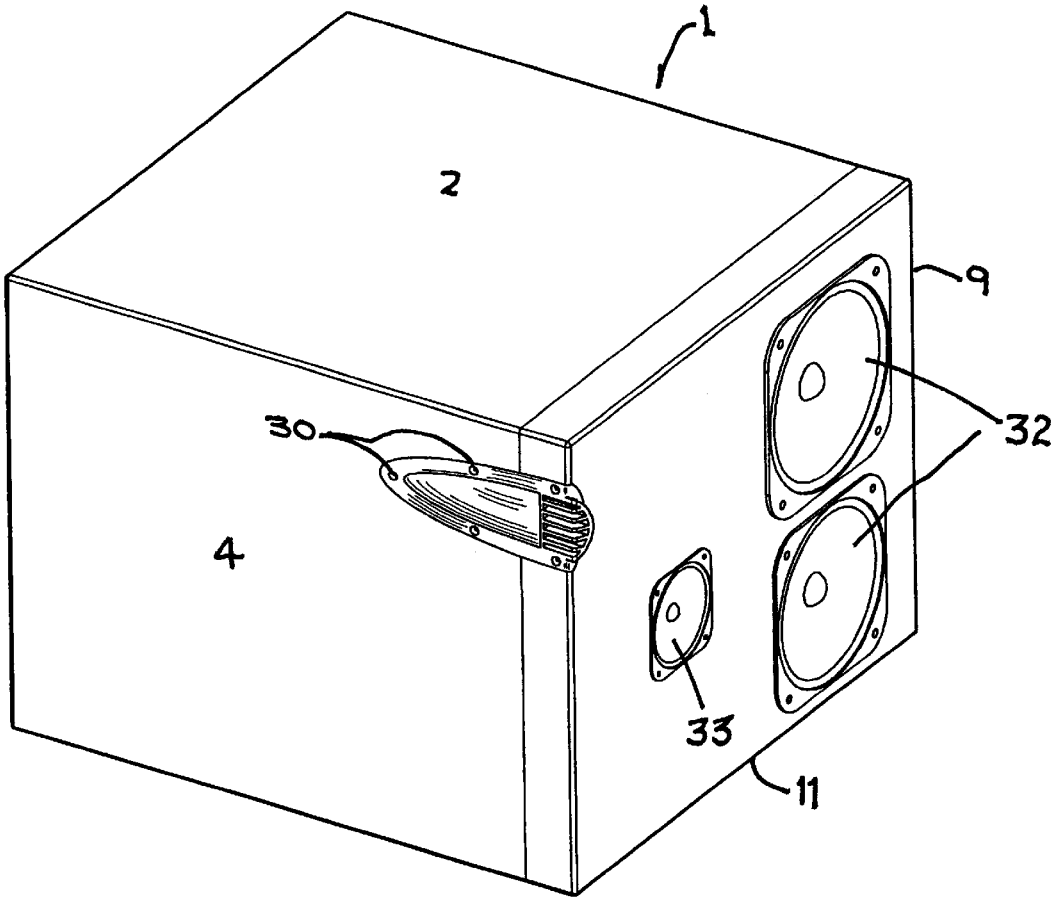
FIG. 1 is a perspective view of a preferred embodiment of the present invention showing the invention when used for a speaker cabinet.

The subject matter of the present invention is directed primarily to a hand grip for cabinets designed to hold audio equipment and, in particular, loudspeakers and amplifiers. The inventions may, however, in some instances, have applications beyond this art. Referring now to the drawings, there is illustrated a preferred embodiment of the invention in the form of a loudspeaker cabinet with a grille cover. In this arrangement, the cabinet 1 may be fabricated of any conventional material ordinarily used for systems of this type. Frequently, these cabinets are made of wood, plastic, particle board, or the like. The cabinet 1, itself, is preferably conventionally formed with six rectangular surfaces including a top 2, bottom 3, opposite sides 4 and 5, a face cover 6 and back (not shown). The face cover 6 may, when the unit is used for a loudspeaker, be formed as a grille cover with appropriate openings for loudspeaker components such as woofers 32, tweeters 33, and the like. These units may be appropriately arranged in the cover 6 depending upon the nature, size, and number of the units used. These components do not form an integral part of the present invention. The face cover 6 is preferably formed with side edges 8 and 9 and end edges 10 and 11. The side edges 8 and 9 should have a sufficient thickness to permit securing means, hereafter described, integrally formed in the handgrip to be attached to the cabinet sides 4 and 5 and face cover 6.

One or more handgrips 15 are secured to the cabinet 1 in the manner hereinafter described. The number of handgrips 15 incorporated into the unit may be varied depending upon the size, shape, and weight of the cabinet 1. In the embodiment illustrated, a pair of handgrips 15 are used on opposite sides 4 and 5 of the cabinet 1. These handgrips 15 are spaced closer to the top 2 of the cabinet 1 than the bottom. Other embodiments contemplate using four handgrips 15 with two positioned on either side 4 or 5 of the cabinet 1 in spaced relation to one another.

Figure 2:
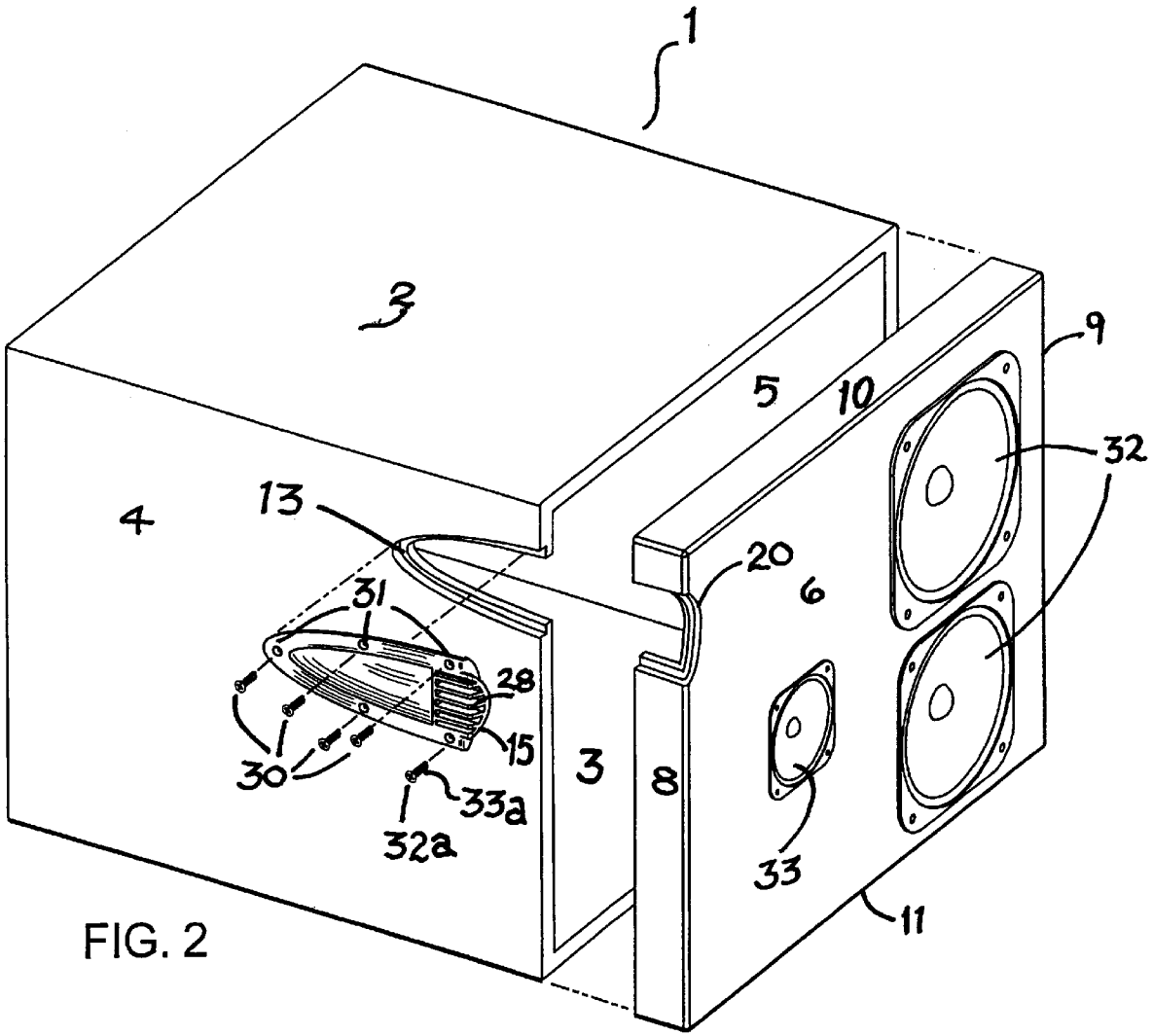
FIG. 2 is an exploded view of the embodiment of FIG. 1.
Figure 3:
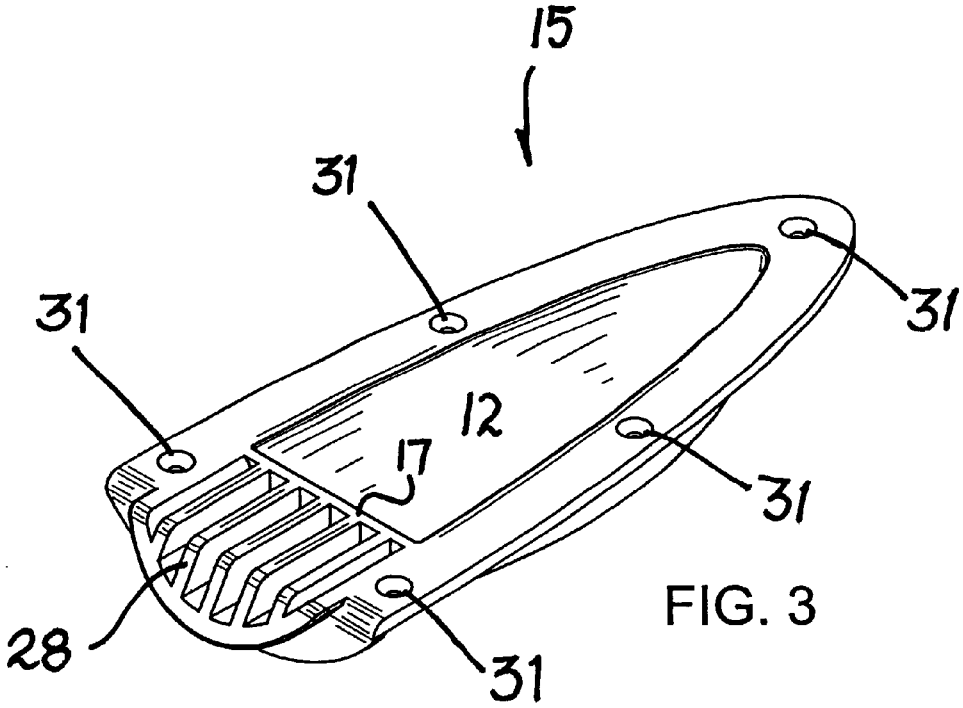
FIG. 3 is a perspective view of the handle element of FIG. 1 showing the outer surface.
Figure 4:
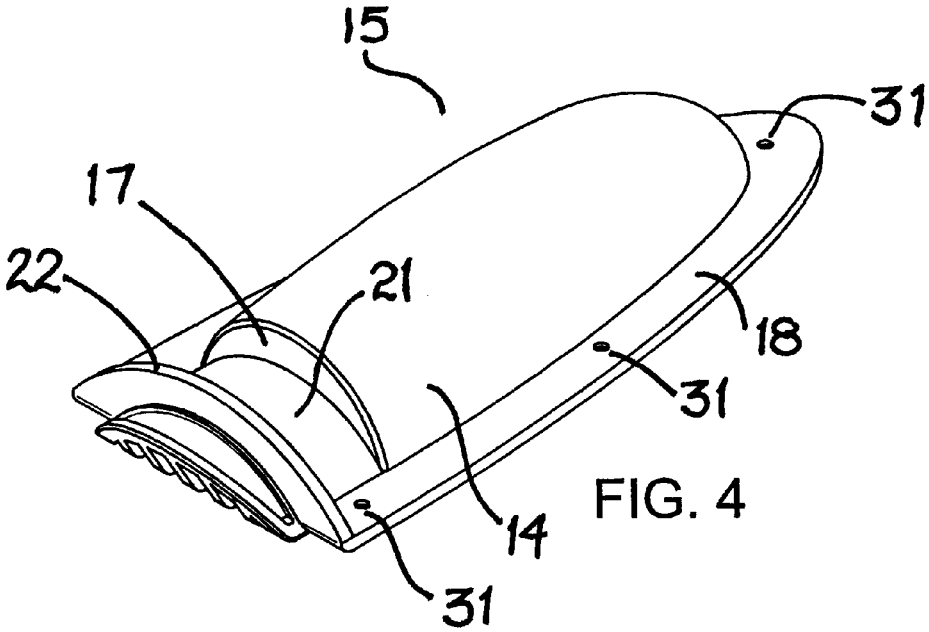
FIG. 4 is a perspective view of the handle element of FIG. 1 showing the side opposite that illustrated in FIG. 3.

Each of the handgrips 15 is positioned within a cutout section 13 of the side 4 or 5 as the case may be. The cutout section 13 (see FIG. 2) lies under a portion of the handgrip 15. The periphery of the cutout section 13 follows the contour of the outer edge of a cup 12 with the cup 12 having a concave shape extending inwardly through the side 4 or 5 into the cabinet interior. The inwardly curved wall 14 defining the cup 12 should have a length and depth sufficient to permit an average adult to insert four fingers into the recess formed by the concave shape of the cup 12. The wall 14 tapers from a deep-end defined by a transverse end wall 17 to a shallow end remote therefrom. The cup need not have a convex shape as described above and may have any recessed shape, such as square, rectangle, triangle, molded to accommodate human fingers, etc.

The cup 12 or concave shape defined by the wall 14 and transverse end wall 17 has extending laterally therefrom a peripheral flange 18. The peripheral flange 18 projects outwardly from the edge of the wall 14 and edge of the end wall 17. This peripheral flange 18 faces the adjacent surface of the side 4 or 5 and extends over the edge of the cutout section 13. The face cover 6 is formed with a recessed contour 20 immediately under and adjacent the handgrip 15. The peripheral flange 18 is formed with an enlarged portion 21 that is shaped complementary to and rests in the recessed contour 20. Extending from the surface of the peripheral flange 18 adjacent the enlarged portion 21 is an outer end wall 22 that is spaced parallel from the end wall 17. The outer end wall 22 and end wall 17 face opposite surfaces of the face cover 6 adjacent the recess contour 20. A portion of the peripheral flange 18 extending beyond the side 4 or 5 may be defined by a series of fins 28. The fins 28 extend outwardly from the outer surface of the end wall 17 to the outer end of the handgrip 15. The handgrip 15 need not have fins 28.

Means may be provided for securing the handgrip 15 directly to the side 4 or 5 and the face cover 6. In the preferred embodiment illustrated, these means comprise a series of fasteners 30 or other means of attachment, such as bolts, rivets, adhesive, or any other type of permanent or removable fastener. The fasteners 30 extend through holes 31 in the peripheral flange 18 with the fasteners 30 having a head 32*a* that engages the flange and a shank 33*a* that extends into the side 4 or 5 and into the side edge 8 or 9 of the face cover 6. The facing surfaces of the outer end wall 22 and end wall 17 are preferably shaped, sized, and spaced apart a distance to snugly engage the full thickness of the face cover 6 so that the handgrip 15 is secured in a fixed and rigid relationship to both the cabinet 1 and the face cover 6.

It should be understood that the foregoing description of the invention is intended merely to be illustrative thereof and that other embodiments, modifications, and equivalents of the invention are within the scope of the invention recited in the claims appended hereto. Further, the fastener described above includes various features that may be employed singularly or in any suitable combination.

Having now described our invention, we claim:

1. An audio unit comprising:

a cabinet with opposing sides and a separable face cover therebetween, the face cover having edges; and means for securing the edges of the face cover to the opposing sides comprising at least one handgrip with a portion of the handgrip engaging a cabinet side and a portion of the handgrip engaging the face cover.

2. An audio unit as set forth in claim 1 comprising a pair of handgrips positioned on either edge of said face cover and with each handgrip engaging a different one of said edges.

3. An audio unit as set forth in claim 2 comprising a loudspeaker wherein said handgrips are each positioned within a cutout section that extends inwardly from the sides, adjacent to the face cover.

4. An audio unit as set forth in claim 3 wherein said handgrips comprise a cup positioned within the cutout section, a peripheral flange extending outwardly from an edge of said cup, and facing at least a portion of the periphery of said cutout section and an adjacent portion of the edge of said face cover, and means securing the peripheral flange to said portion of the edge of said cutout section and to the side of said face cover.

5. An audio unit as set forth in claim 4 wherein said cup has a concave shape defined by an inwardly curved wall extending within the cabinet from the peripheral flange.

6. An audio unit as set forth in claim 5 wherein an end wall truncates a portion of the cup and forms an outer wall of the handgrip positioned and shaped to face the inner surface of a portion of said face cover.

7. An audio unit as set forth in claim 6 wherein said peripheral flange projects over both surfaces of the edge of the face cover.

8. An audio unit as set forth in claim 7 wherein the surface of peripheral flange projecting over both surfaces of the edge of the face cover is formed with a series of fins.

9. An audio unit as set forth in claim 4 wherein the adjacent portion of the side edge of said face cover has a recessed contour, and a portion of the peripheral flange projects over the recessed contour and is sized to engage the space defined by the recessed contour.

10. An audio unit as set forth in claim 4 having an end wall and an outer end wall extending from the peripheral flange respectively in facing relation to opposite surfaces of the face cover adjacent the handgrip.

11. An audio unit comprising:

a cabinet with opposing sides and a face cover therebetween; and a handgrip comprising a concave wall projecting into one of the sides with an outwardly extending flange extending from an edge of the concave wall into an engaging relation with the one of the sides and an edge of the face cover.

12. An audio unit as set forth in claim 11 comprising a loudspeaker wherein the at least one handgrip is positioned within a cutout section that extends inwardly from the sides, adjacent to the face cover.

13. An audio unit as set forth in claim 12 wherein the at least one handgrip comprises a cup positioned within the cutout section, a peripheral flange extending outwardly from an edge of said cup, and facing at least a portion of a periphery of said cutout section and an adjacent portion of the edge of said face cover, and means for securing the peripheral flange to said portion of the periphery of said cutout section and to the edge of said face cover.

14. An audio unit as set forth in claim 13 wherein said cup has a concave shape defined by an inwardly curved wall extending within the cabinet from the peripheral flange.

15. An audio unit as set forth in claim 14 wherein an end wall truncates a portion of the cup and forms an outer wall of the at least one handgrip positioned and shaped to face the inner surface of a portion of said face cover.

16. An audio unit as set forth in claim 15 wherein said peripheral flange projects over both surfaces of the edge of the face cover.

17. An audio unit as set forth in claim 16 wherein a surface of the peripheral flange projecting over both surfaces of the face cover is formed with a series of fins.

18. An audio unit as set forth in claim 13 wherein the adjacent portion of the edge of said face cover has a recessed contour, and a portion of the peripheral flange projects over the recessed contour and is sized to engage the space defined by the recessed contour.

19. An audio unit as set forth in claim 13 having an end wall and an outer end wall extending from the peripheral flange in facing relation to opposite surfaces of the face cover adjacent the handgrip.

20. A handgrip securing a face cover to a side of a cabinet, comprising:

a concave wall having an outwardly extending flange shaped to fit into a recess in a cabinet sides, with the flange shaped and sized to face the side and an abutting edge of the side;

an outer end wall, extending from the flange, configured to face a front surface of the face cover, and means for securing the handgrip to the side and the face cover.

* * * * *

UNITED STATES PATENT AND TRADEMARK OFFICE

CERTIFICATE OF CORRECTION

PATENT NO. : 6,848,627 B2
DATED : February 1, 2005
INVENTOR(S) : James M. Oepping et al.

It is certified that error appears in the above-identified patent and that said Letters Patent is hereby corrected as shown below:

Column 5,
Line 20, should read, -- (b) an additive pump in fluid communication --

Signed and Sealed this

Twenty-sixth Day of April, 2005

JON W. DUDAS
*Director of the United States Patent and Trademark Office*